US005316495A

United States Patent [19]

Frantz

[11] Patent Number: 5,316,495

[45] Date of Patent: May 31, 1994

[54] LATCHING SYSTEM FOR ELECTRICAL CONNECTORS

[75] Inventor: Robert H. Frantz, Newville, Pa.

[73] Assignee: The Whitaker Corporation, Wilmington, Del.

[21] Appl. No.: 4,867

[22] Filed: Jan. 15, 1993

[51] Int. Cl.[5] ..... H01R 13/62

[52] U.S. Cl. ..... 439/372; 439/350; 292/115

[58] Field of Search ..... 439/350–358, 439/359, 372, 370, 362, 345, 564; 285/320; 403/321, 322, 323; 292/43, 55, 115, 212

[56] References Cited

U.S. PATENT DOCUMENTS

| | | | |
|---|---|---|---|
| 2,902,665 | 9/1959 | D'Amico | 339/184 |
| 3,056,942 | 10/1962 | Carbaugh et al. | 339/92 |
| 3,187,292 | 6/1965 | Small et al. | 339/94 |
| 3,777,298 | 12/1973 | Newman | 434/372 |
| 4,181,391 | 1/1980 | Kilsdonk | 339/92 M |
| 4,398,780 | 8/1983 | Novotny et al. | 439/362 |
| 4,460,230 | 7/1984 | McKee et al. | 439/359 |
| 4,832,624 | 5/1989 | Waters et al. | 439/680 |
| 4,895,535 | 1/1990 | Emadi et al. | 439/681 |
| 4,929,184 | 5/1990 | Emadi et al. | 439/681 |
| 4,948,181 | 8/1990 | Pritchard | 292/115 |
| 5,092,791 | 3/1992 | Contarino | 439/564 |

*Primary Examiner*—Gary F. Paumen
*Assistant Examiner*—Hien D. Vu

[57] ABSTRACT

A system for releasably securing to each other a first and a second connector by means of a pair of pivotable latching members, one or each side of the first connector and each pivotable into and out of a latched position with respect to a corresponding one of a pair of catches on the second connector, as controlled by a manually-operable jack-screw arrangement for each latching member, mounted on said first connector.

8 Claims, 6 Drawing Sheets

LATCHING SYSTEM FOR ELECTRICAL CONNECTORS

FIELD OF THE INVENTION

This invention relates to latching systems for holding electrical connectors together, and especially to such systems for releasably clamping together connectors of different sizes.

BACKGROUND OF THE INVENTION

It is sometimes desirable to hold the two halves of an electrical connector releasably to each other in their mated conditions, by means over and beyond the friction of pin against socket which is often relied upon, so that there is no chance of their accidental dislodgement, complete or partial, or relative motion due to vibration, gravity pull, accidental contact, or the like. This is particularly important where a first connector is mounted on a panel and mated with a second connector which has one or more other connectors mounted on its rear side, so that there is a distinct tendency for the second connector to loosen and perhaps ultimately fall out.

Mechanisms are known in which the pins of spring-mounted jaws, one on each side of one connector, can be manually pinched open and then allowed to close about a retaining catch on another connector of the same size, once the two connectors are fully mated. However, in some instances a pair of connectors are to be mated with each other which are of different sizes, e.g. a 68-position to 50-position adapter mated with a 50-position connector. Despite the difference in connector size, it is desirable to be able to assure that such connectors are securely and releasably held together by an appropriate mechanism. It is also sometimes desirable to secure one or more other connectors to the rear of one of the pair of connectors, while still retaining the ability to secure the original pair of connectors to each other. It has been found difficult to provide an appropriate latching system for assuring that the connectors will then remain mated as desired, and which is convenient and easy to use.

It is therefore a principal object of this invention to provide a new and advantageous mechanism for releasably latching together a pair of electrical connectors.

SUMMARY OF THE INVENTION

In accordance with the invention, there is provided a releasable latching mechanism for holding together at least a pair of connectors, comprising a pair of pivotable latching members, one on each side of a first of said connectors, and a pair of catches spaced apart along the mating face of the other of said connectors and positioned so as to be captured by a corresponding one of said latching members when the latching member is pivoted in one direction, and to be free of the latching member when the latching member is pivoted in the opposite direction. A pair of threaded latch-control shafts are provided, one on each side of said first connector and each manually rotatable in either direction by turning its free end, thereby to control the pivotal position of its associated latching member, so as to clamp said first connector to said second connector or to release the connectors from other, as desired.

Preferably the first connector is mounted in a case and the two threaded shafts supported on the case, outboard of the second connector. Preferably also, each threaded shaft is positioned to operate a jack-screw arrangement containing a spring which biases the corresponding latching member in the direction to engage its corresponding catch. The jack-screw arrangement serves to retract the latching member pivotally in response to turning of the threaded shaft in one direction, so as to release the latching member from its corresponding catch; it also serves to force the latching member into clamping engagement with the catch upon continued turning of the threaded shaft in the other direction. In a preferred form, each shaft is provided with a threaded axial opening at its free end, in which a corresponding additional threaded shaft, mounted on a third mated connector, can be secured to permit manual rotation of the threaded shafts of the first connector by rotation of the free end of the additional threaded shafts.

BRIEF DESCRIPTION OF THE DRAWINGS

These and other objects and features of the invention will be more readily understood from a consideration of the following detailed description, taken with the accompanying drawings, in which.

DETAILED DESCRIPTION OF PREFERRED EMBODIMENTS

Figure 1:
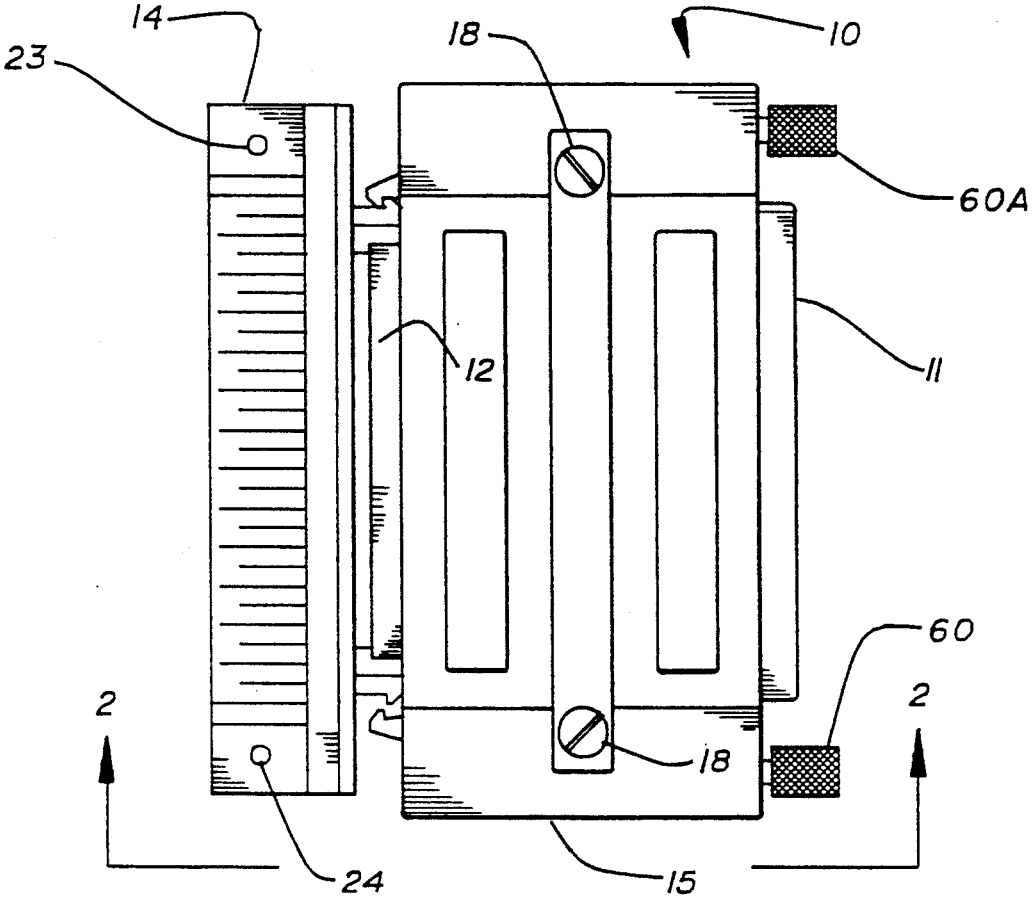
FIG. 1 is a top plan view of an adapter which, according to a preferred embodiment of the invention, is enclosed in a case and is releasably latched to a mating connector, the adaptor providing at its free face a greater number of connector positions than are available in the mated connector.
Figure 2:
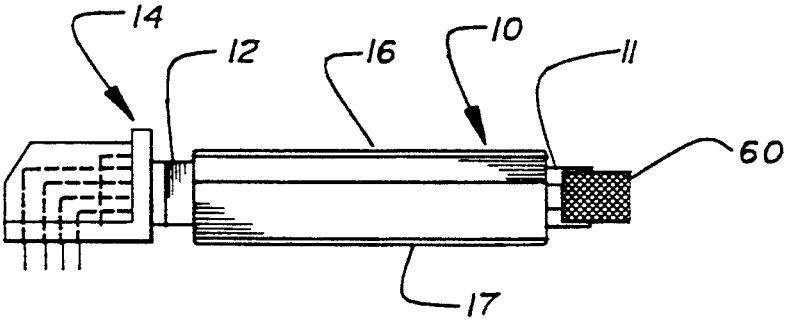
FIG. 2 is an end view of the system of FIG. 1.
Figure 3:
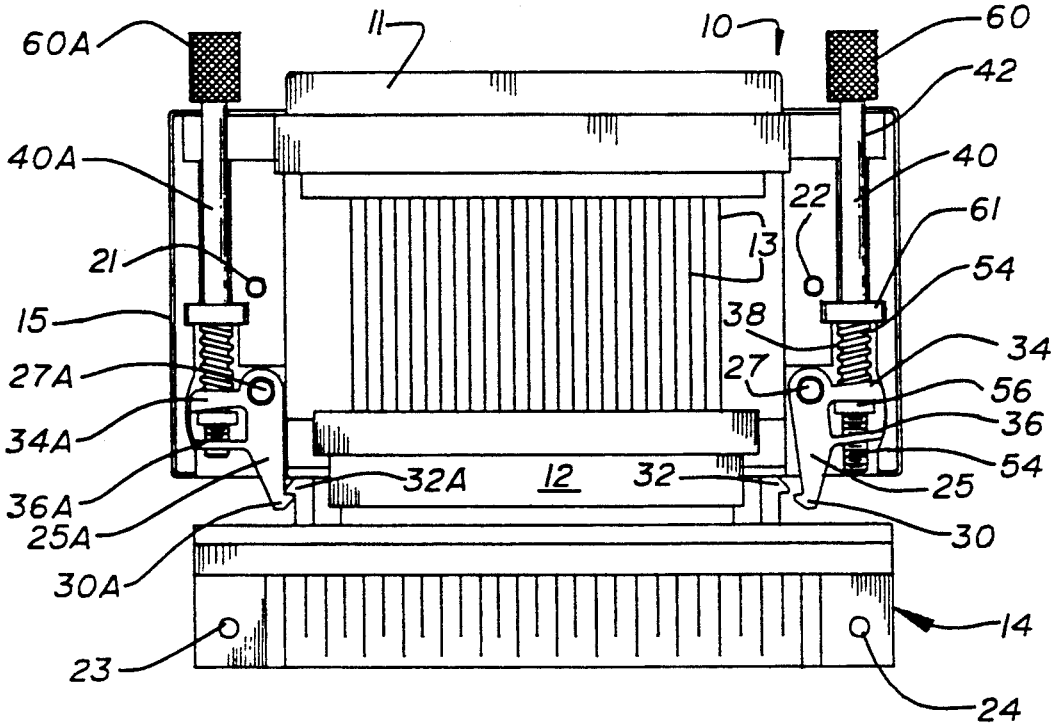
FIG. 3 is a top plan view of the system of FIG. 1 with the cover of the case removed.
Figure 15:
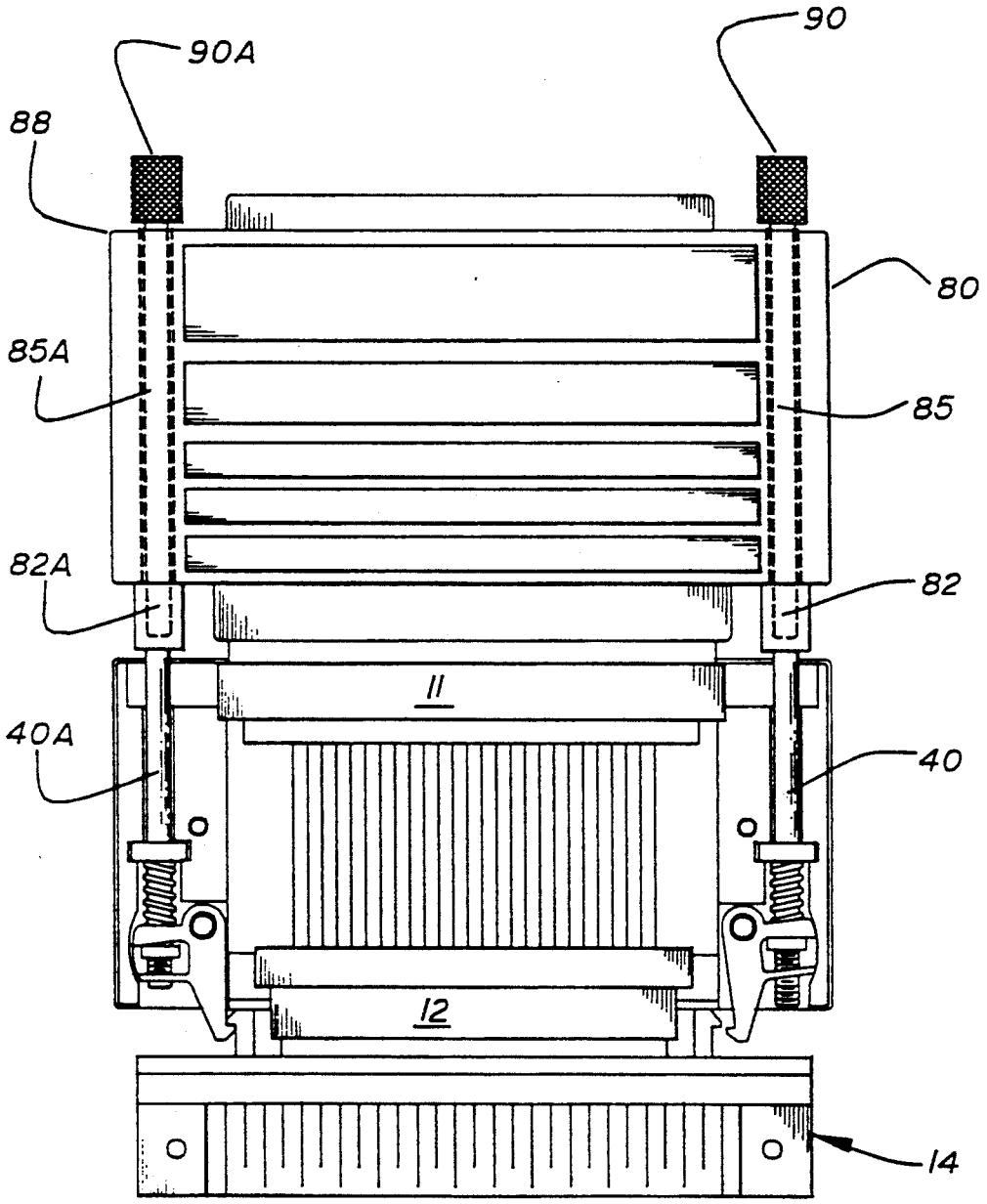
FIG. 15 is a top plan view showing the connector system of FIG. 3, with the top of the case removed, with a third connector mated to the rear of one of the connectors of FIG. 3, and with additional shafts which and are engaged with the free ends of the two threaded shafts of FIG. 3 to permit operation of the latching members by the additional shafts.

Referring to the preferred embodiments of the invention shown the drawings, FIGS. 1-3 show an adapter 10 electrically connecting a standard 68-position, series 50 connector 11 to a standard 50-position, series 0.050 connector 12 by 50 insulated wires such as 13, (FIG. 3), one set of 25 above this other. Plugged into the front of connector 12 is a standard mated connector 14, in this case of a type in which two sets of 25 leads each are bent at right angles, as shown in FIG. 2. The rear side of the connector 11 is adapted to receive a 68-wire cable, or to mate with a 68-position, series 0.050 connector (as shown in FIG. 15).

Figure 4:
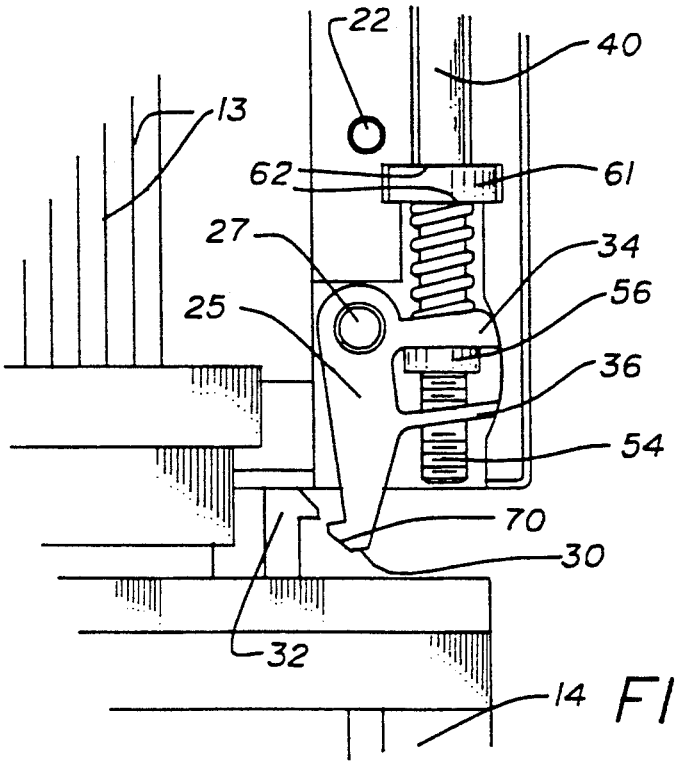
FIG. 4 is an enlarged fragmentary view showing the lower right-hand portion of FIG. 3.
Figure 12:
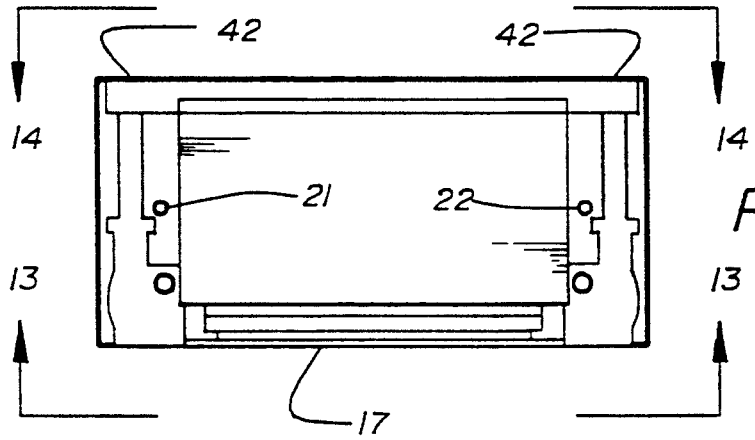
Figure 13:
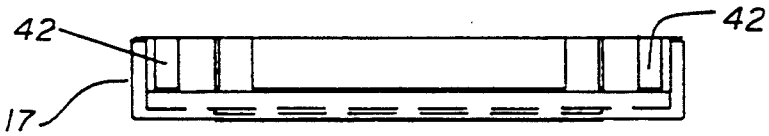
Figure 14:
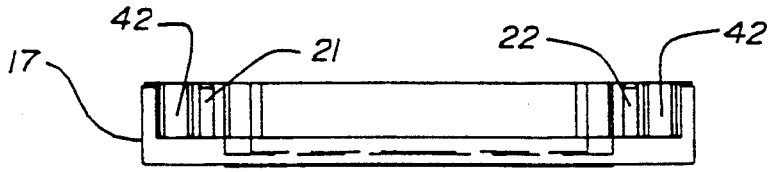

The adapter 10 nests in a case 15 having a top 16 and a bottom 17 (FIG. 2) held together by screws 18 (FIG. 1), which threadingly engage a corresponding pair of posts 21 and 22 rising up from the bottom of the case (FIGS. 3, 4 and 12). FIGS. 7–14 show the compartments in the top and bottom of the case, in which the adapter 10 nests itself. Connector 14 is here assumed to be secured to a computer panel (not shown) by appropriate fasteners extending through holes 23, 24.

To secure the adapter 10 releasably to the panel-mounted connector 14, there is employed the latching system of the invention now to be described. Since the two parts of the latching system on opposite sides of the adapter are identical in this example, only one will be described in detail, the other being indicated by corresponding numerals with the suffix A.

Figure 5:
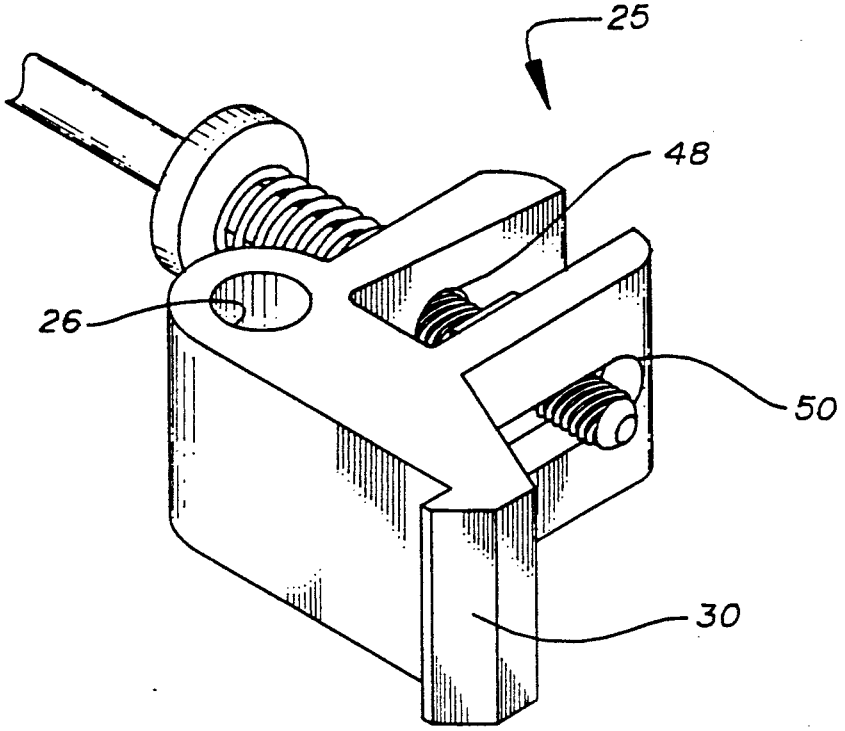
FIG. 5 is a perspective view of a portion of a latching member according to a preferred embodiment of the invention.
Figure 6:
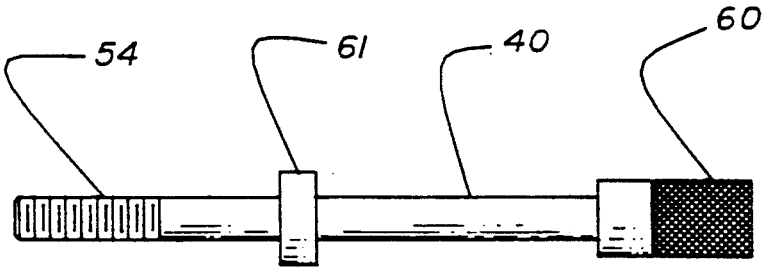
FIG. 6 is a side elevational view of the threaded operating shaft for the pivoted latch member.
Figure 7:
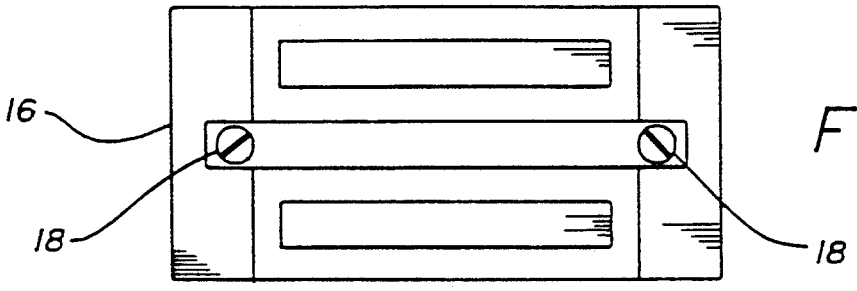
FIGS. 7, 8, 9 and 10 are, respectively, a top plan view of the top of the case, a bottom plan view of the top of the case, a side view of the case taken along lines 9—9 of FIG. 8, and a side view of the case taken along lines 10—10 of FIG. 8.
Figure 8:
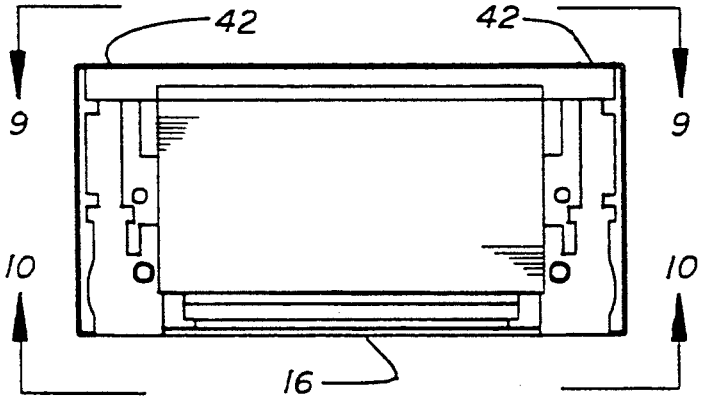
Figure 9:
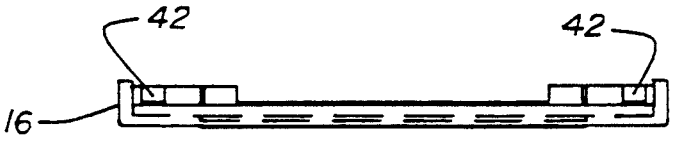
Figure 10:
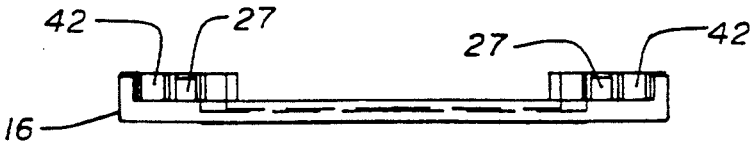
Figure 11:
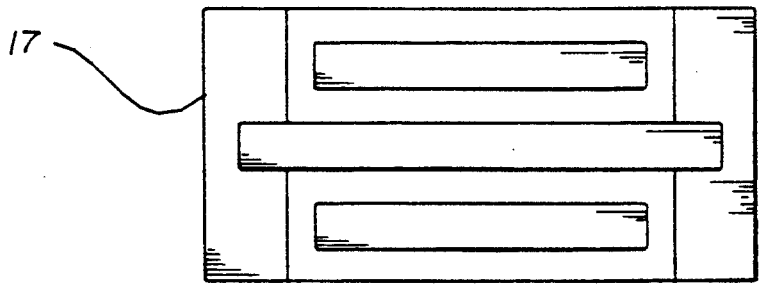
FIGS. 11, 12, 13 and 14 are, respectively, a bottom plan view of the bottom of the case, a top plan view of the bottom of the case, a side view of the case taken along lines 13—13 of FIG. 11, and a side view taken along lines 14—14 of FIG. 11.

A pivotable latching member 25 is provided with a bore 26 (FIG. 5), into which pivot post 27 extends; post 27 is molded integrally with the bottom of case 15, and extends upwardly from the bottom of the case. The latching member 25 is provided at its distal end with a hook-like latching tip 30 (FIG. 4) which is capable of engaging the tip of a corresponding catch 32 on the front of the connector 14; it is understood that an identical but oppositely facing catch 32A is provided on the connector 14, to operate similarly with corresponding latching member 25A.

Latching member 25 is provided with integral parallel flanges 34 and 36 (FIG. 4), by means of which latching member 25 is pivoted controllably, in response to axial motion of threaded shaft 40. Shaft 40 is supported near its rearward end by a cut-out 42 in case 15, and nearer its forward end it extends through a pair of respective clearance bores 48 and 50 in flanges 34 and 36. Shaft 40 has a threaded portion 54 which is threaded into a traveller nut 56 trapped between flanges 34 and 36, and prevented from rotating by abutment against the bottom of the case 15. A knurled head 60 is provided at the rearward end of shaft 40 to enable its easy manual turning by the user. Threaded shaft 40 is also provided with an integral radial flange 61, which is held against axial motion by walls 62 (FIGS. 4 and 8) extending from the top and bottom of the case 15.

Threaded screw shaft portion 54 preferably has a left-hand thread, so that as it is turned clockwise by the user (as viewed from beyond the knurled head) it causes nut 56 to screw itself forwardly along shaft 40 until it contacts flange 36, tending to push that flange forwardly and thereby pivot latching member 25 clockwise as viewed in FIG. 4, to clamp latching tip 30 firmly behind and against catch 32. As the threaded shaft 40 is rotated in the opposite direction, nut 56 begins to screw itself rearwardly along the threaded shaft toward flange 34. However, latching member 25 is biased toward catch 32 by a spiral compression spring 68, and when nut 56 is in its intermediate position between flanges 34 and 36, latching member 25 can be pushed back counterclockwise against the spring bias and when released will spring back to its original position. Accordingly, when connectors 12 and 14 are not yet mated, and latching member 25 is in a position to interfere with the advance of catch 32 as connectors 12 and 14 approach each other, the bevel 70 (FIG. 4) on latching tip 30 will cause latching number 25 to pivot counterclockwise as it is pushed aside by the advancing connector catch 32 during mating, until catch 32 snaps past the latching tip 30 and is loosely secured by the latching member. To release the latching member fully from the catch, threaded screw member 40 is turned to move nut 56 beyond its intermediate position and against flange 34, so as to pivot latching member 25 entirely free of catch 32 and thus release the mated connectors 12 and 14 for disconnection.

The other screw-threaded shaft 40A is operated the same as is shaft 40, with the same results.

In some known circumstances it is desirable to connect another connector 80 (FIG. 15), rather than just a cable, to the exposed side of connector 11. In such cases it is often still desirable to be able to clamp the connectors 12 and 14 securely but releasably to each other. Accordingly, as shown, the screw shafts 40, 40A are provided at their exposed ends with respective threaded bores 82, 82A in which a pair of correspondingly-threaded extension shafts 85, 85A are threadingly engaged; to secure the extension shafts in these positions, their threads may be coated with an adhesive before screwing them in place. The extension shafts are supported rotatably in appropriate circular openings and/or bores in case 88 of connector 80, and in this example are provided with knurled free ends 90, 90A so they can conveniently be turned manually to turn shafts 40, 40A respectively. In this way release and latching of the front two connectors 12 and 14 can be controlled from beyond the other added connector. If desired, additional extension shafts may be provided for still further additional connectors, in the same manner.

There has therefore been provided a simple but effective latching mechanism suitable for clamping and releasing a pair of connectors, especially connectors of different widths, by means of jack-screw actuated latches, operable by simple manual turning of a pair of threaded shafts.

In the example illustrated, the nut is captured in a recess or passage between the two flanges 34 and 36, but the recess or passage may be formed by a bore or slot of any shape in the latching member, between the walls of which the nut is located.

While the invention has been described with particular reference to specific embodiments in the interest of complete definiteness, it will be understood that it may be embodied in a variety of forms diverse from those specifically shown and described, without departing from the spirit and scope of the invention.

I claim:

1. A system for releasably securing a first connector to a confronting second connector, comprising:

a pair of catches spaced apart along said second connector:

a pair of pivotably-mounted latching members mounted on said first connector, each latching member being pivotable between a latched position in which it is latched to a corresponding one of said catches and a released position in which it is free of said corresponding latch;

a pair of manually-rotatable shaft members secured to said first connector for controlling actuation of said latching members between said latched and released positions thereof;

the end of each of said shaft members which is remote from its corresponding latching member containing a threaded bore;

said system comprising a third connector mated with said first connector; and a pair of additional threaded shaft members each mounted on said third connector and threadingly engaging one of said bores in said shaft members, to permit turning of said shaft members of said first connector by turning of said additional threaded shaft members.

2. The system of claim 1, comprising a pair of jack-screw arrangements mounted on said first connector and each operable in response to turning of one of said shaft members to pivot its corresponding latching member between said latched and released positions thereof.

3. A system for releasably securing a first connector to a confronting second connector, comprising:

a pair of catches spaced apart along said second connector:

a pair of pivotably-mounted latching members mounted on said first connector, each latching member being pivotable between a latched position in which it is latched to a corresponding one of said catches and a released position in which it is free of said corresponding latch;

a pair of manually-rotatable shaft members secured to said first connector for controlling actuation of said latching members between said latched and released positions thereof, each of said latching members has a passage through it; said system comprising supports holding each of said shafts for rotation while securing it against axial motion; and a pair of traveller nuts, each nut being threadingly engaged with one of said shaft members in the corresponding one of said passages, each nut being held against rotation, and each nut being responsive to turning of one of said shaft members to move against one side or another of said one passage, depending on the direction of turning of said one shaft member, thereby to move said latching member between said latched and released positions thereof.

4. The system of claim 3, comprising spring means urging said latching members toward their latched positions.

5. A connector system, comprising:

a first connector;

a second connector matable with said first connector;

first and second catches mounted on said second connector;

first and second latching members mounted on opposite sides of said first connector and extending toward second connector;

each of said latching members being pivotable to be free of a corresponding one of said catches when pivoted in one direction, and to engage said corresponding catch when pivoted in the opposite direction;

first and second threaded shafts rotatably mounted on opposite sides of said first connector; and first and second latch-control mechanisms responsive to said first and second threaded shafts respectively, to move said first and second latching members, respectively, in said one direction or in said opposite direction depending on the direction of rotation of the threaded shaft, thereby to control latching and unlatching of said first and second connectors to and from each other, and means for spring-biasing each of said latching members toward its latched position.

6. The system of claim 5, wherein each of said first and second mechanisms comprises a jack-screw arrangement actuated by the corresponding one of said threaded shafts to pivot its associated latching member in either said first or said opposite direction depending on the direction of rotation of said corresponding threaded shaft.

7. The system of claim 6, wherein each of said mechanisms comprises:

a traveller nut threadingly engaging an associated one of said threaded shafts, means permitting said associated threaded shaft to turn but preventing it from moving axially, an abutment for holding said traveller nut against rotation nut but permitting it to move axially, whereby said traveller nut moves axially in a first or a second direction along said threaded shaft depending on the direction of rotation of its associated threaded shaft, and a recess in said latching member in which said nut is located whereby axial motion of said nut pivots said latching member in said first or said opposite directions depending on the direction of rotation of said threaded shaft.

8. The system of claim 7, wherein said recess is large enough to permit substantial axial travel of said nut along said threaded shaft between opposite walls of said recess, and spring means acting between said threaded shaft and said latching member to spring-bias said latching member towards its latching position.

* * * * *